US007686774B2

(12) United States Patent
Yang

(10) Patent No.: US 7,686,774 B2
(45) Date of Patent: Mar. 30, 2010

(54) ELECTROMAGNETIC CUSHION PROVIDING KNOCKING AND OSCILLATING MASSAGES TO ACUPOINTS IN MALE AND FEMALE PRIVATE BODY PARTS

(76) Inventor: Yingwu Yang, No. 88, Daguan Building, Kunming, Yunnan (CN) 650106

( * ) Notice: Subject to any disclaimer, the term of this patent is extended or adjusted under 35 U.S.C. 154(b) by 1087 days.

(21) Appl. No.: 11/294,980

(22) Filed: Dec. 6, 2005

(65) Prior Publication Data

US 2006/0089576 A1 Apr. 27, 2006

(51) Int. Cl.
*A61H 7/00* (2006.01)
*A61H 19/00* (2006.01)
*A61H 1/00* (2006.01)

(52) U.S. Cl. ..... 601/91; 601/49; 601/53; 601/95

(58) Field of Classification Search ..... 601/46, 601/48–51, 53, 78, 84–87, 89–91, 93, 95, 601/97, 98
See application file for complete search history.

(56) References Cited

U.S. PATENT DOCUMENTS 4,936,292 A * 6/1990 Hidetsugu ..... 601/104
5,167,225 A * 12/1992 Cheng-I ..... 601/112
5,573,500 A * 11/1996 Katsunuma et al. ..... 601/111
5,681,266 A * 10/1997 Lin ..... 601/104
5,868,688 A * 2/1999 Avidor et al. ..... 601/87
5,904,660 A * 5/1999 Kim ..... 601/108
5,974,615 A * 11/1999 Schwarz-Hartmann et al. ..... 15/22.4
6,361,511 B1 * 3/2002 Shim ..... 601/137
6,475,171 B1 * 11/2002 Williams ..... 601/98
7,338,417 B2 * 3/2008 Kang ..... 482/148
2004/0215116 A1 * 10/2004 Kim ..... 601/136

* cited by examiner

*Primary Examiner*—Justine R Yu
*Assistant Examiner*—Kristen C Matter

(57) ABSTRACT

The invention relates to massages for acupoints in sensitive private parts of male and female private parts. It comprises a cushion shell, knocking and oscillating massagers for acupoints of the private parts, a sponge pad, an arc cover board, a bottom cover of cushion shell, a computer controlling board of integrated circuits and a hand-held switch controller. The knocking and oscillating head for massaging private parts is arranged and mounted at the position of the central line C of the cushion shell. An arc supporting plate for knocking and oscillating massages for private parts on it is installed at the massage head. The distances between each of the knocking massagers can be adjusted within a proper range. The benefits of the invention are its simple structure, good curative effect and convenience in use.

6 Claims, 1 Drawing Sheet

ELECTROMAGNETIC CUSHION PROVIDING KNOCKING AND OSCILLATING MASSAGES TO ACUPOINTS IN MALE AND FEMALE PRIVATE BODY PARTS

BACKGROUND OF THE INVENTION

1. Field of the Invention

This invention relates to massages. Specifically, the present invention relates to an electromagnetic cushion providing massages for acupoints in sensitive male and female private body parts.

2. Description of the Related Art

At present, there are various types of massage equipments with different massaging patterns. For example, massage chairs are used for the whole body, and massage cushions are used for other bodily parts, such as back, legs or feet. For the curative effects, these devices make an individual comfortable since the stressed muscles are relaxed and fatigue is eliminated after the massage.

The massage cushion of the present invention is not available in conventional massage equipment. It provides knocking and oscillating heads for massaging private parts, perineum acupoint and Changqiang acupoint, based on the curative theory of acupoint therapeutics of traditional Chinese medicine. The massage program is under control of the control program in the computer controlling board of integrated circuits, which provides the optimum massage manipulation imitating professional masseuses. The unique oscillating and knocking frequency, speed and strength are unrivalled by the professional masseuses.

The quality of the human body deteriorates and suffers from various chronic diseases after the midlife of a person. This is caused by venation blockage and the decline of cell vigor in the body. The venation is the passage of qi and blood in the body, and the blocked circulation of the qi and blood leads to the qi and blood being deficient and disabled. Additionally, the ineffective collaboration between visceras results in an unbalanced Yin and Yang. A cell is the minimal unit of body structure and its vigor decides the quality of life. The deficiency of cell energy causes dysfunction and various kinds of chronic disease may result.

Thus, it would be a distinct advantage to have an electromagnetic cushion for giving massages to acupoints in male and female private body parts. It is an object of the present invention to provide such an apparatus.

SUMMARY OF THE INVENTION

An object of the present invention is to provide an electromagnetic cushion providing knocking and oscillating massages to acupoints of male and female private parts, which gives knocking and oscillating massages to acupoints in sensitive private parts of body parts, dredges the venation and the passage of qi and blood, boosts the circulation of blood, improves the cell vigor, resumes the enginery of human body, intensifies the quality of the body and eliminates chronic diseases.

DESCRIPTION OF THE INVENTION

Figure 1:
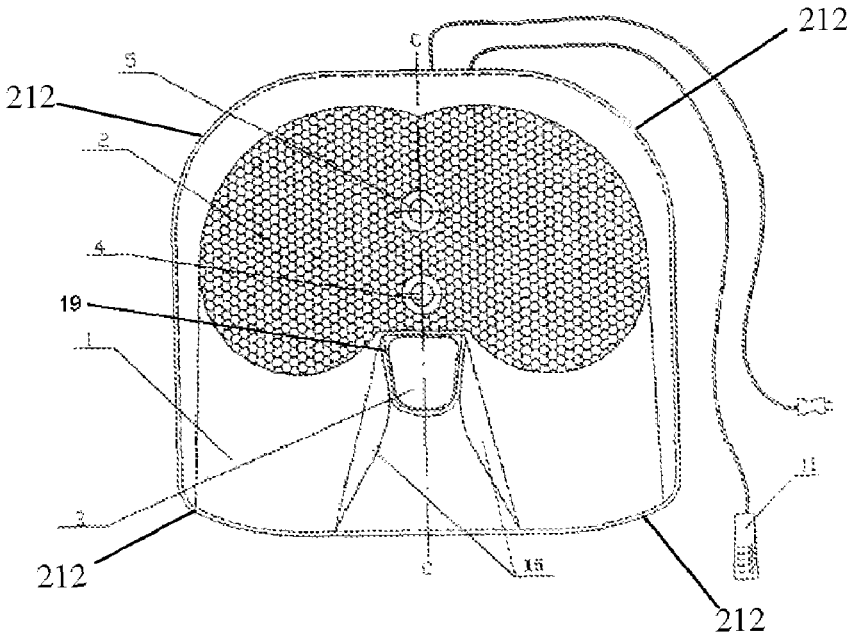
FIG. 1 is a schematic diagram of the electromagnetic cushion for giving knocking and oscillating massages to acupoints in male and female private parts.
Figure 2:
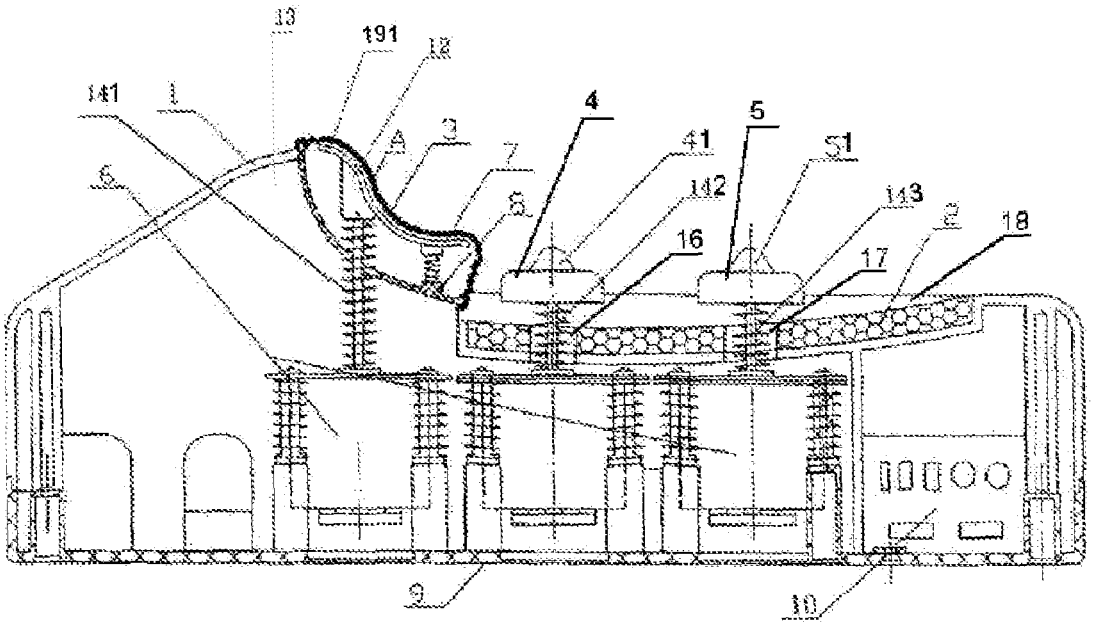
FIG. 2 is a section view of C-C in FIG. 1.

Referring to FIG. 1, a knocking and oscillating head 3 for massaging private parts is arranged on the central line C of a cushion shell 1 and covers an arc pressing cover 8 and an arc supporting plate 7 for knocking and oscillating massages for private parts which is installed in an interior portion of the electromagnetic cushion and is connected with the top of a mandrel 141 of the electromagnetic oscillator 6. A knocking and oscillating head for massaging the perineum acupoint (massage head) 4 is arranged at a distance of 6 to 8.5 centimeters and is connected with the top of a mandrel 142 of the electromagnetic oscillator 6. A knocking and oscillating head for massaging the Changqiang acupoint (Changqiang massaging head) 5 is arranged at a distance of 5.5 to 8 centimeters from the massage head 4. A sinking platform of a hip seat 18 of the cushion shell 1 is filled with a sponge pad 2. The electromagnetic oscillator 6 is set on the guide rod for supporting the bottom cover 9 of the cushion shell 1 with a computer controlling board 10 of integrated circuits and hand-held switch controller 11 installed on its back.

The technical scheme of the present invention is achieved with an electromagnetic cushion for giving knocking and oscillating massages to acupoints of male and female private parts. The present invention comprises the cushion shell 1, the sponge pad 2, the knocking and oscillating head for massaging private parts 3, the knocking and oscillating head for massaging the perineum acupoint 4, the knocking and oscillating head for massaging the Changqiang acupoint 5, the electromagnetic knocking and oscillating massager 6, the arc supporting plate 7, the arc cover board 8, the bottom cover of the cushion shell 9, the computer controlling board 10 of integrated circuits and the hand-held switch controller 11.

The knocking and oscillating head for massaging private parts 3 includes the arc supporting plate 7 for knocking and oscillating massages for private parts. The knocking and oscillating head for massaging the perineum acupoint 4 and the knocking and oscillating head for massaging the Changqiang acupoint 5 are arranged and mounted at the position of the central line C of the cushion shell 1. The distance from one side of the knocking and oscillating head for massaging private parts 3 to the center of the knocking and oscillating head for massaging the perineum acupoint 4 is approximately 6 centimeters. The distance from the center of the knocking and oscillating head for massaging the perineum acupoint 4 to the center of the knocking and oscillating head for massaging the Changqiang acupoint 5 is approximately 5.5-8 centimeters. The soft cones 41, 51 of the knocking and oscillating head for massaging the perineum acupoint 4 and the knocking and oscillating head for massaging the Changqiang acupoint 5 are approximately 1.5 to 3.5 centimeters higher than the surface layer of the sponge pad 2. The knocking and oscillating head for massaging the private parts 3 is made of soft rubber with an arc shape similar to the outer shape of private parts of a sitting male or female user, which include ripple surrounding, with a groove 11 inside the surroundings of an underside 12 and engaged with the protruding platform 13 surrounding the arc cover board 8. An arc supporting plate 7 for knocking and oscillating massage for private parts is installed under the soft rubber cover. The lowest point of the arc supporting plate 7 for knocking and oscillating massage for private parts is approximately 1 to 4.5 centimeters from the surface layer of the sponge pad 2. Three electromagnetic oscillators 6 are arranged and mounted inside the cushion shell 1 and respectively connected with the oscillating mandrel and the arc supporting plate 7 for knocking and oscillating massages for private parts, the knocking and oscillating head for massaging the Changqiang acupoint, and the knocking and oscillating head for massaging the perineum acupoint. The exterior cones 41 and 42 of the knocking and oscillating head for massaging the perineum acupoint 4 and the knocking and oscillating head for massaging the Changqiang acupoint 5 are made of a rubberized material having a height of between 1 to 4 centimeters and the diameters of the lower bottom portion of the cones 41, 42 of between 2 and 4 centimeters. The bottom portions of the cones 41, 42 are fixed to the top of the mandrel 142, 143 of the electromagnetic oscillators.

The hip seat 18 is positioned on top of the cushion shell and is kidney-shaped and has two symmetrical arc spherical surfaces, which intersect on the central line C of the cushion shell and naturally form a hip shape with the central line C protruding with the two sides being concave. It surrounds and vertically sinks 1 to 2 centimeters. Two installing holes 16 and 17 of knocking and oscillating heads for massaging Changqiang acupoint and perineum acupoint (4 and 5) are arranged on a protruding central line. The central line and the scrotum-imitating-shaped arc line at the position of the user's scrotum form a protruding slope 15. The arc grooves for the user's legs are located at two sides of the protruding slope, so that a saddle-shaped protruding slope, which is wide in front, narrow in back portion, narrow in the upper portion, wide in the bottom portion, and short in front and high in the back, is naturally formed. In addition, a hole 19 for installing the massage head 3 is located at the scrotum position. The intersecting angles of the two ends, top surface and sides of the cushion shell are connected with each other by arcs 212. The cushion shell is molded as a single part by a plastic injection molding machine. The cushion includes magnetic slices with proper magnetic intensity which are arranged inside the soft rubber massage head.

The user's seat sinks approximately one centimeter. As discussed above, a saddle-shaped protruding slope is formed at the private parts position and the shape of the slope is corresponding to the multiple curves of private parts, high in and inside position and low in an outside position, narrow in the inside and wide in the outside, narrow in the upper position and wide in the lower portion with arc grooves for legs on both sides. The knocking and oscillating heads for massaging the Changqiang acupoint 5, perineum acupoint 4 and private parts 3 are arranged side by side on the central line of the cushion shell. The soft rubber cones of the massage heads of Changqiang acupoint and perineum acupoint, and the arc supporting plate for knocking and oscillating massages for private parts are fixed to the top of the mandrels of the electromagnetic oscillators which is arranged on the guide rod for support of the cushion shell. The bottom cover of the cushion shell and the cushion shell are connected together by bolts.

The hip sinking platform of the cushion shell is filled with the sponge pad and the computer controlling board of integrated circuits is arranged in the case of the bottom cover of cushion shell. Based on the curative theory of acupoint therapeutics of Chinese traditional medicine, the oscillating massage heads are arranged at private parts acupoints, so as to massage the acupoints by knocking and oscillating. The present invention can unblock the venation and the passage of qi and blood, boost the circulation of blood, activate the cells, resume the functions of viscera, balance the Yin and Yang, and cure various diseases.

The advantage of the present invention is that users can easily change the private parts massage heads according to their sex, and can massage their body parts at any place and any time. The cushion may be positioned on a sofa or a wooden chair. Users can use it while reading books or newspapers, watching TV, or doing other tasks without interfering with the user's other tasks while simultaneously enjoying a massage.

While the present invention has been described with reference to certain embodiments, it will be understood by those skilled in the art that various changes may be made and equivalents may be substituted without departing from the scope of the present invention. In addition, many modifications may be made to adapt a particular situation or material to the teaching of the present invention without departing from its scope. Therefore, it is intended that the present invention not be limited to the particular embodiment disclosed, but that the present invention will include all embodiments falling within the scope of the appended claims.

What is claimed is:

1. An electromagnetic cushion for giving knocking and oscillating massages to acupoints in male or female private parts, the electromagnetic cushion comprising:

a cushion shell;

a sponge pad;

a knocking and oscillating head for massaging private parts;

a knocking and oscillating head for massaging the perineum acupoint;

a knocking and oscillating head for massaging the Changqiang acupoint;

three electromagnetic oscillators;

an arc cover board;

a bottom cover of the cushion shell;

a computer controlling board of integrated circuits; and and a switch controller;

whereby a user sits upon the cushion shell and receives a massage of the acupoints in male or female private parts; wherein:

the cushion shell includes a hip seat positioned on top of the cushion shell, the hip seat being kidney-shaped and having two symmetrical arc spherical surfaces which intersect on a central line of the cushion shell and naturally form a hip shape with the central line protruding;

two sides of the hip seat being concave, and the surroundings sunk in vertically between approximately 1 and 2 centimeters;

two installing holes of knocking and oscillating heads for massaging Changqiang acupoint and perineum acupoint are arranged on the protruding central line; the central line and a scrotum-imitating-shaped arc line at the scrotum position of the cushion shell form a protruding slope;

arc grooves for user's leg are located at two sides of the protruding slope; and a hole for installing the knocking and oscillating head for massaging private parts is located at the scrotum position of the cushion shell;

whereby intersecting angles of two ends of the cushion shell and a top surface and sides of the cushion shell are connected with each other by arcs.

2. The electromagnetic cushion of claim 1 wherein:

the knocking and oscillating head for massaging private parts, the knocking and oscillating head for massaging the perineum acupoint, and the knocking and oscillating head for massaging the Changqiang acupoint are arranged on the central line of the cushion shell, the knocking and oscillating head for massaging private parts has a arc supporting plate for knocking and oscillating massages for private part arranged thereon;

the distance from a first side of the knocking and oscillating head for massaging private parts to a center of the knocking and oscillating head for massaging the perineum acupoint is between approximately 6 and 8 centimeters; the distance from the center of the knocking and oscillating head for massaging the perineum acupoint to a center of the knocking and oscillating head for massaging the Changqiang acupoint is between approximately 5.5 and 8 centimeters; and the soft cones of the knocking and oscillating head for massaging the perineum acupoint and the knocking and oscillating head for massaging the Changqiang acupoint are between approximately 1.5 and 3.5 centimeters higher than a surface layer of the sponge pad.

3. The electromagnetic cushion of claim 1 wherein: the knocking and oscillating head for massaging the private parts is constructed of a soft rubber and has a groove inside the surroundings of its underside and is engaged with a protruding platform on the surroundings of the arc cover board; and an arc supporting plate for knocking and oscillating massages for private parts is arranged under the soft rubber, a lowest point of the arc supporting plate for knocking and oscillating massages for private parts being between approximately 1 and 4.5 centimeters higher than a surface layer of the sponge pad.

4. The electromagnetic cushion of claim 3, wherein the three electromagnetic oscillators are arranged inside the cushion shell and respectively connected with three oscillating mandrels, and the top arc supporting plate for knocking and oscillating massages for the private parts, the knocking and oscillating head for massaging the Changqiang acupoint and the knocking and oscillating head for massaging the perineum acupoint.

5. The electromagnetic cushion of claim 4, wherein the knocking and oscillating head for massaging the perineum acupoint and the knocking and oscillating head for massaging the Changqiang acupoint include exterior cones constructed of a rubberized material with a height of between approximately 1 to 4 centimeters, and the diameter of a lower bottom portion of the cones of between approximately 2 and 4 centimeters, and the bottom portions are fixed to the mandrels of the electromagnetic oscillators.

6. The electromagnetic cushion of claim 1, wherein the cushion includes magnetic slices arranged inside a soft rubber portion of each knocking and oscillating head.

* * * * *